US010558159B2

(12) United States Patent
Yoshie et al.

(10) Patent No.: US 10,558,159 B2
(45) Date of Patent: Feb. 11, 2020

(54) IMAGE FORMING DEVICE AND METHOD FOR CONTROLLING THE SAME

(71) Applicant: Konica Minolta Inc., Chiyoda-ku, Tokyo (JP)

(72) Inventors: Naoki Yoshie, Ibaraki (JP); Chiaki Yamada, Ibaraki (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/207,608

(22) Filed: Dec. 3, 2018

(65) Prior Publication Data

US 2019/0171138 A1 Jun. 6, 2019

(30) Foreign Application Priority Data

Dec. 5, 2017 (JP) ..... 2017-233502

(51) Int. Cl.
*G03G 15/20* (2006.01)
*G03G 15/00* (2006.01)

(52) U.S. Cl.
CPC ..... *G03G 15/6585* (2013.01); *G03G 15/2021* (2013.01); *G03G 15/2039* (2013.01)

(58) Field of Classification Search
CPC ..... G03G 15/6585; G03G 2215/00805; G03G 2215/0081
See application file for complete search history.

(56) References Cited

U.S. PATENT DOCUMENTS

2006/0291927 A1* 12/2006 Roof ..... G03G 15/2064 399/341
2007/0086803 A1* 4/2007 Kimura ..... B41J 2/325 399/69
2009/0003904 A1* 1/2009 Yasutomi ..... G03G 15/2021 399/341
2012/0107004 A1* 5/2012 Sonohara ..... G03G 15/6585 399/69

FOREIGN PATENT DOCUMENTS

JP 2009008709 A 1/2009

* cited by examiner

*Primary Examiner* — Carla J Therrien
(74) *Attorney, Agent, or Firm* — Cantor Colburn LLP

(57) ABSTRACT

An image forming device includes: a fixing unit that fixes an image formed on a recording medium; a heating unit that heats a recording medium that has been subjected to a fixing process by the fixing unit; and a controller that sets a glossiness of an image on a recording medium, wherein the controller controls a heating amount with the heating unit depending on the set glossiness.

4 Claims, 8 Drawing Sheets

FIG. 7

| | t1(sec) | t2(sec) | t3(sec) | T1(°C) | T2(°C) | T3(°C) | S | GLOSSINESS | LIGHTING MODE OF HEATER |
|---|---|---|---|---|---|---|---|---|---|
| EXAMPLE (1) | 0.2 | 0.6 | 1.3 | 85 | 85 | 70 | 11 | 27 | 100°C, ONE HEATER IS LIGHTED |
| EXAMPLE (2) | 0.2 | 1.0 | 2.4 | 85 | 89 | 70 | 27 | 24 | 100°C, TWO HEATERS ARE LIGHTED |
| EXAMPLE (3) | 0.2 | 1.5 | 3.6 | 85 | 93 | 70 | 49 | 22 | 100°C, THREE HEATERS ARE LIGHTED |
| EXAMPLE (4) | 0.2 | 0.6 | 1.0 | 85 | 80 | 70 | 7 | 29 | 80°C, ONE HEATER IS LIGHTED |
| EXAMPLE (5) | 0.2 | 1.0 | 1.8 | 85 | 82 | 70 | 16 | 26 | 80°C, TWO HEATERS ARE LIGHTED |
| EXAMPLE (6) | 0.2 | 1.4 | 2.6 | 85 | 83 | 70 | 25 | 24 | 80°C, THREE HEATERS ARE LIGHTED |
| EXAMPLE (7) | 0.2 | 0.5 | 0.5 | 85 | 70 | 70 | 2 | 37 | NO HEATING IN NON-CONTACT MANNER |
| EXAMPLE (8) | 0.2 | 2.2 | 4.7 | 85 | 100 | 70 | 83 | 45 | 100°C, FIVE HEATERS ARE LIGHTED |

| S | LogS | GLOSSINESS |
|---|---|---|
| 2 | 0.30103 | 36 |
| 5 | 0.69897 | 32 |
| 10 | 1 | 29 |
| 20 | 1.30103 | 25 |
| 40 | 1.60206 | 22 |

IMAGE FORMING DEVICE AND METHOD FOR CONTROLLING THE SAME

CROSS-REFERENCE TO RELATED APPLICATION(S)

The present application claims priority under 35 U.S.C § 119(e) to Japanese patent Application No. 2017-233502, filed on Dec. 5, 2017, is incorporated herein by reference in its entirety.

BACKGROUND

Technological Field

The present disclosure relates to an image forming device that fixes an image formed on a recording medium and then further heats the recording medium.

Description of the Related Art

The glossiness of an image required for a finished printed matter may be different depending on the contents of the image or the like. Conventionally, various studies have been made on the glossiness of an image formed on a recording medium.

For example, the glossiness has been lowered by lowering a fixing temperature of an image. However, when the fixing temperature is lowered, the glossiness is reduced, but a strength (fixing strength) at which a toner is fixed to a recording medium is also lowered.

JP 2009-8709 A proposes an image forming device that reduces a glossiness and improves a fixing strength of a toner on a recording medium by heating the toner after an image is fixed.

However, the technique described in JP 2009-8709 A does not indicate specific control conditions for obtaining a desired glossiness.

SUMMARY

The present disclosure has been achieved in view of such circumstances, and an object thereof is to provide an image forming device capable of reliably obtaining a desired glossiness in a formed image.

To achieve the abovementioned object, according to an aspect of the present invention, an image forming device reflecting one aspect of the present invention comprises: a fixing unit that fixes an image formed on a recording medium; a heating unit that heats a recording medium that has been subjected to a fixing process by the fixing unit; and a controller that sets a glossiness of an image on a recording medium, wherein the controller controls a heating amount with the heating unit depending on the set glossiness.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 7 is a table illustrating seven sets of concrete examples for six variables regarding a value of S;

DETAILED DESCRIPTION OF EMBODIMENTS

Figure 1:
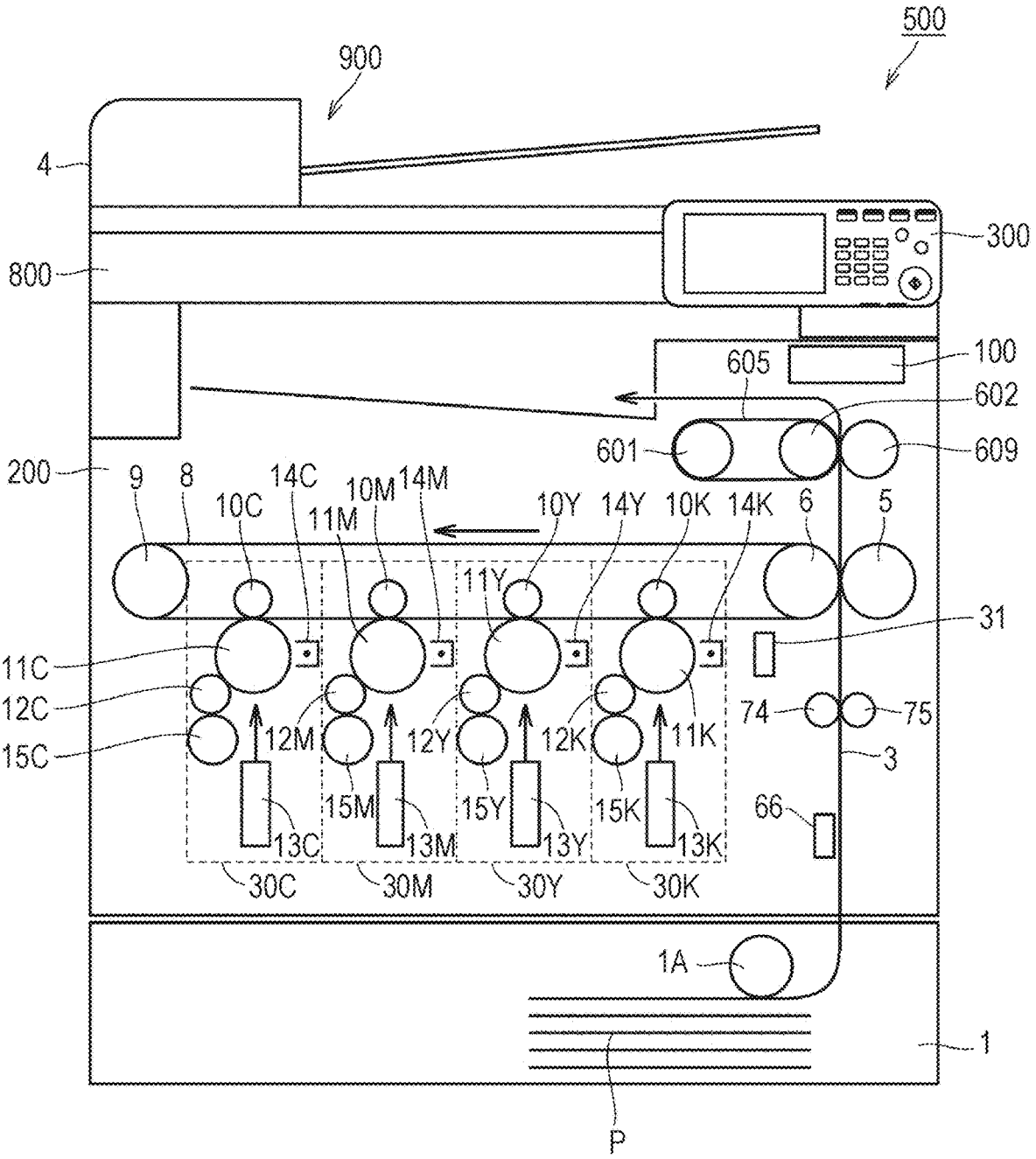
FIG. 1 is a diagram schematically illustrating a configuration of a multi-functional peripheral (MFP) which is an example of an image forming device.

Hereinafter, one or more embodiments of an image forming device according to the present invention will be described with reference to the drawings. However, the scope of the invention is not limited to the disclosed embodiments. In the following description, the same parts and constituent elements are denoted by the same reference numerals. The names thereof and the functions thereof are also the same. Therefore, description thereof will not be repeated.

[1] Schematic Configuration of Image Forming Device

FIG. 1 is a diagram schematically illustrating a configuration of an MFP 500 which is an example of an image forming device. In FIG. 1, as an example of an image forming device, an image forming device having a tandem type color image forming unit mounted thereon is illustrated.

Referring to FIG. 1, the MFP 500 includes a control unit 100 and an image forming unit 200. Typically, the image forming unit 200 forms a color or monochrome image on sheet P loaded in a sheet feeding cassette 1 based on image information obtained by optically reading the contents of a document to be printed by a scanner unit 800. An auto document feeder (ADF) 900 is connected to the scanner unit 800, and a document to be printed is sequentially conveyed from the ADF 900.

More specifically, the image forming unit 200 includes process units 30C, 30M, 30Y, and 30K (hereinafter, also referred to generically as "process units 30") for four colors of cyan (C), magenta (M), yellow (Y), and black (K), respectively. The process units 30 of the respective colors are arranged along a movement direction of a transfer belt 8, and sequentially form toner images of corresponding colors on the transfer belt 8.

The process units 30C, 30M, 30Y, and 30K include primary transfer rollers 10C, 10M, 10Y, and 10K (hereinafter, also referred to generically as "primary transfer rollers 10"), photoreceptors 11C, 11M, 11Y, and 11K (hereinafter, also referred to generically as "photoreceptors 11"), developing rollers 12C, 12M, 12Y and 12K (hereinafter, also referred to generically as "developing rollers 12"), print heads 13C, 13M, 13Y, and 13K (hereinafter, also referred to generically as "print heads 13"), chargers 14C, 14M, 14Y, and 14K (hereinafter, also referred to generically as "chargers 14"), and toner units 15C, 15M, 15Y, and 15K (hereinafter, also referred to generically as "toner units 15"), respectively.

When receiving a print request in response to an operation of a user on an operation panel 300 or the like, each of the process units 30 forms a toner image of each of colors constituting an image to be printed on the photoreceptor 11, and transfers the formed toner image of each of the colors onto the transfer belt 8 at the same timing as another process unit 30. At this time, the primary transfer roller 10 moves a toner image on the corresponding photoreceptor 11 to the transfer belt 8.

In each of the process units, the charger 14 charges a surface of the rotating photoreceptor 11, and exposes the surface of the photoreceptor 11 to light according to image information to be printed by the print head 13. As a result, an electrostatic latent image representing a toner image to be formed is formed on the surface of the photoreceptor 11. Thereafter, the developing roller 12 supplies a toner of the toner unit 15 to the surface of the photoreceptor 11. As a result, an electrostatic latent image is developed as a toner image on the photoreceptor 11. Thereafter, the primary transfer roller 10 sequentially transfers the toner image developed on the surface of each of the photoreceptors 11 onto the transfer belt 8 rotated by a driving motor 9. As a result, the toner images of the respective colors are superimposed, and a toner image to be transferred is formed on sheet P.

The image forming unit 200 includes a density sensor 31 for detecting a toner density on the transfer belt 8 in order to stabilize the density of a toner image to be printed.

As image stabilization control using the density sensor 31, several printed patches for detecting a toner density are formed on the transfer belt 8 by changing a development output of a developing apparatus and changing a toner density. The image forming unit 200 can obtain a stable toner density at all times during printing by detecting a toner density using the density sensor 31 and feeding back the toner density to a development output of the developing apparatus depending on the result. For example, in a case where a main switch of the device main body is turned on, in a case where a toner cartridge is exchanged, or in a case where a predetermined number of sheets are printed, image stabilization control can be executed.

The image forming unit 200 further includes a sheet feeding cassette 1. In the sheet feeding cassette 1, a sheet feeding roller 1A takes out sheet P loaded in the sheet feeding cassette 1. Sheet P thus taken out is conveyed along a conveying path 3 by a conveying roller 74 or the like. The conveying roller 74 makes sheet P stand by at a position where sheet P has reached a timing sensor. Thereafter, the conveying roller 74 conveys sheet P to a secondary transfer roller 5 at the same timing as timing when the toner image formed on the transfer belt 8 reaches the secondary transfer roller 5.

The toner image on the transfer belt 8 is transferred onto sheet P by the secondary transfer roller 5 and a facing roller 6. Typically, by applying a predetermined potential (for example, about +2000 V) corresponding to a charge of the toner image to the secondary transfer roller 5, a force to electrically attract the toner image on the transfer belt 8 to the secondary transfer roller 5 is generated. As a result, the toner image is transferred onto sheet P.

Furthermore, the toner image transferred onto sheet P is processed in a fixing apparatus (fixing unit 60 in FIG. 2 described later) including a fixing belt 605 or the like, and is thereby fixed to sheet P Sheet P to which the toner image has been fixed is output to a sheet discharge tray. As a result, a series of print processes are completed.

In the MFP 500, the fixing belt 605 is an example of a fixing member, and a pressurizing roller 609 is an example of a pressurizing member.

A smoothness sensor 66 is disposed along the conveying path 3. The smoothness sensor 66 detects the smoothness of a surface of sheet P on the conveying path 3, and outputs the smoothness to the control unit 100. The MFP 500 may include any type of sensor including an air leakage type sensor as the smoothness sensor 66.

[2] Configuration of Fixing Unit and the Vicinity Thereof

Figure 2:
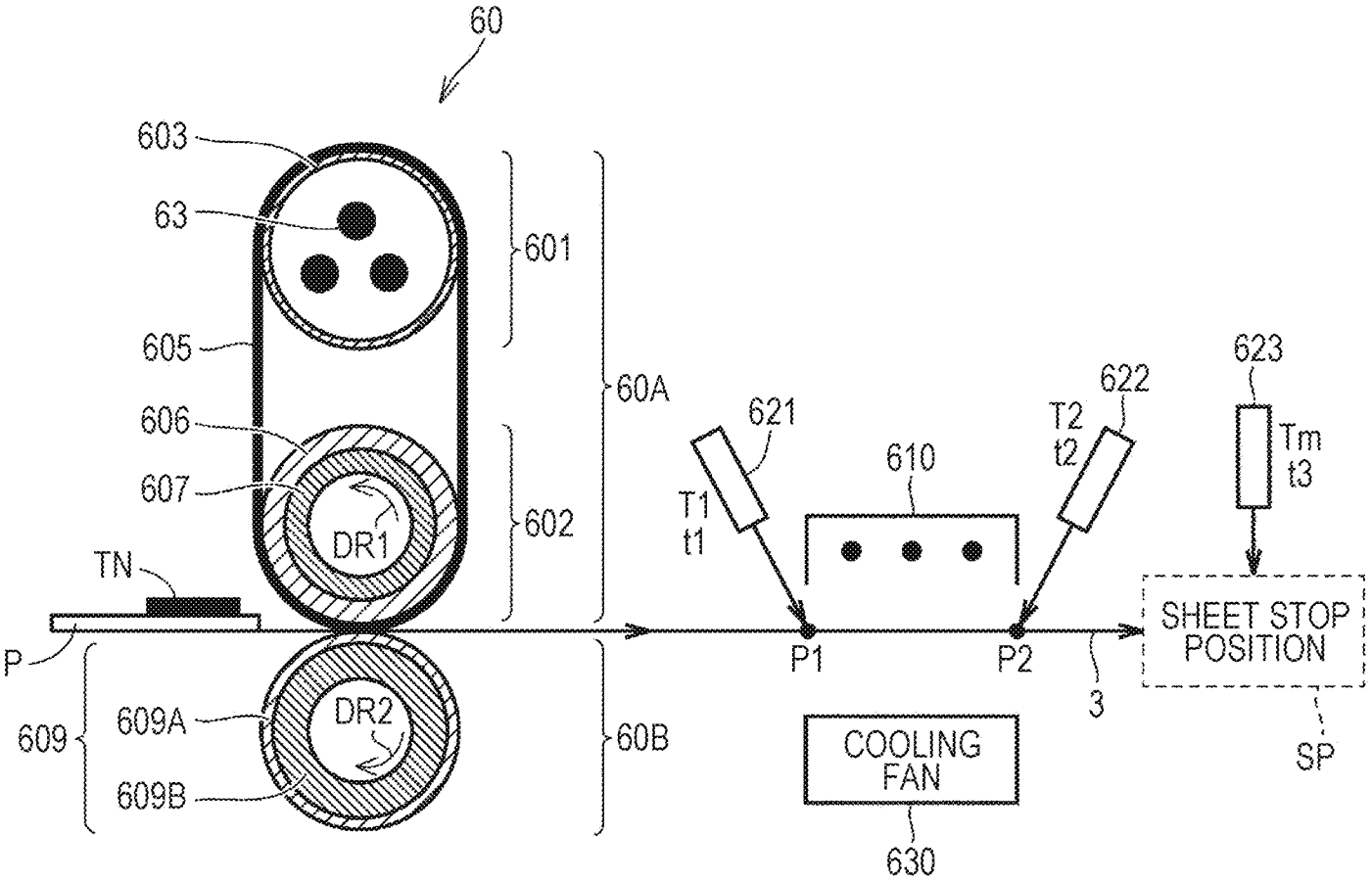
FIG. 2 is a diagram schematically illustrating a configuration of a fixing unit of the MFP in FIG. 1 and the vicinity thereof.

FIG. 2 is a diagram schematically illustrating a configuration of the fixing unit 60 of the MFP 500 in FIG. 1 and the vicinity thereof. As illustrated in FIG. 2, the fixing unit 60 includes a heating unit 60A and a pressurizing unit 60B. The heating unit 60A includes a heating roller 601 and a fixing roller 602. A fixing belt 605 is stretched over the heating roller 601 and the fixing roller 602. For ease of explanation, FIG. 2 illustrates an arrangement of the heating roller 601 and the fixing roller 602 rotated clockwise by 90 degrees with respect to FIG. 1.

The heating roller 601 houses a heater 63 therein. The heater 63 heats a surface of the fixing belt 605. A target temperature for heating is, for example, 80 to 250° C. On the surface of the fixing belt 605, a temperature sensor (not illustrated in FIG. 1) ("temperature sensor 64" in FIG. 3) is disposed. In the MFP 500, the temperature of the fixing belt 605 is monitored by the temperature sensor, and this temperature is fed back to a temperature control circuit (not illustrated). As a result, the fixing belt 605 is controlled to a predetermined temperature.

In the fixing roller 602, a cylindrical metal substrate is coated with a rubber 603. The rubber has heat resistance. A material of the rubber is, for example, a silicone rubber or a fluorocarbon rubber. The rubber has a hardness of about 5 degrees to 50 degrees. The rubber has a thickness of, for example, about 1 mm to 50 mm. In order to increase releasability of a surface of the rubber, a material for coating the cylindrical substrate of the fixing roller 602 may be a fluorine-based resin or the like.

For example, the fixing belt 605 is manufactured by coating a substrate formed of a metal, a resin, or the like with a rubber layer and further disposing a release layer on a surface of the rubber layer. In a case where the substrate is formed of a resin, the resin is preferably a resin having high heat resistance, such as polyimide. The rubber layer is preferably formed of a silicone rubber or a fluorocarbon rubber having high heat resistance. The rubber layer has a thickness of, for example, about 0.1 mm to 5 mm. The rubber has a thickness of, for example, about 5 degrees to 50 degrees. The release layer is formed of a fluorine-based resin such as a perfluoroalkoxy fluorine resin (PFA) or polytetrafluoroethylene (PTFA).

The fixing belt 605 preferably has an MD-1 hardness (type C) of 85° or more and 95° or less. The MD-1 hardness of less than 85° increases a contact area with a boundary surface to an uneven portion to increase a possibility of occurrence of image disturbance. Furthermore, the MD-1 hardness of less than 85° may deteriorate durability of the fixing belt 605. The MD-1 hardness of more than 950 decreases a contact area with a protruded portion and may deteriorate a fixing strength.

The pressurizing unit 60B is mainly constituted by the pressurizing roller 609. In the pressurizing roller 609, a cylindrical metal substrate 609A is coated with a rubber 609B. The rubber 609B is a rubber having high heat resistance, for example, a silicone-based rubber or a fluorine-based rubber. The rubber 609B has a thickness of, for example, about 0.1 mm to 20 mm. The rubber 609B has a hardness of, for example, about 5 degrees to 50 degrees. A release layer is preferably disposed on a surface of the rubber 609B.

In order to quickly heat the pressurizing unit 60B, a heat source (heater) may be installed inside the pressurizing roller 609.

Figure 3:
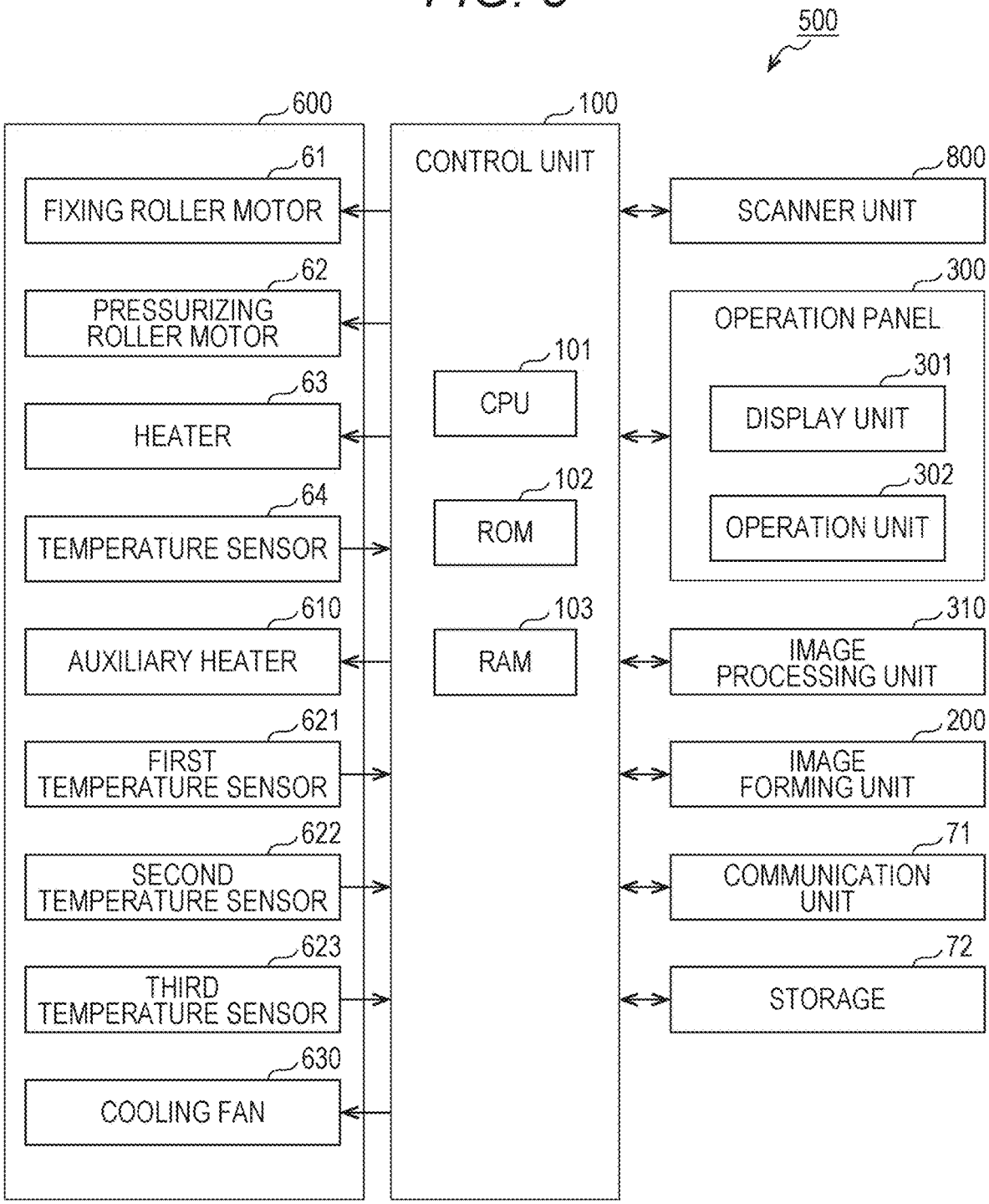
FIG. 3 is a diagram schematically illustrating a hardware configuration of the MFP.

As illustrated in FIG. 3 described later, the fixing unit 60 includes a fixing roller motor 61 and a pressurizing roller motor 62. The fixing roller motor 61 rotationally drives the fixing roller 602. As the fixing roller motor 61, for example, a servo motor is mounted. The arrow DR1 indicates a direction in which the fixing roller 602 rotates.

The pressurizing roller motor 62 rotationally drives the pressurizing roller 609. As the pressurizing roller motor 62, for example, a pulse motor is mounted. The arrow DR2 indicates a direction in which the pressurizing roller 609 rotates.

The fixing belt 605 is in contact with the pressurizing roller 609. A portion where the fixing belt 605 and the pressurizing roller 609 are in contact with each other constitutes a part of the conveying path 3 of sheet P. To this portion, a toner image formed on sheet P is fixed. Here, a portion where the fixing belt 605 and the pressurizing roller 609 are in contact with each other is also referred to as a "nip portion". In the MFP 500, a load applied to a sheet at the nip portion is, for example, about 1500 N to 5000 N.

In FIG. 2, the double arrow D1 indicates a direction in which the nip portion intersects with a main surface of sheet P conveyed to the nip portion. The MFP 500 has a mechanism for changing a relative position between the fixing roller 602 and the pressurizing roller 609 in the direction indicated by the double arrow D1. This mechanism is illustrated as a roller position adjusting motor 65 in FIG. 3 described later. In the MFP 500, for example, the roller position adjusting motor 65 changes a distance between the fixing roller 602 and the pressurizing roller 609 in the direction indicated by the double arrow D1, and the length of the nip portion in the conveying path 3 is thereby changed.

The MFP 500 further includes an auxiliary heater 610. The auxiliary heater 610 heats sheet P to which an image has been fixed by the fixing unit 60. In an example, the auxiliary heater 610 heats sheet P in a non-contact manner. The auxiliary heater 610 is constituted by, for example, one or more glass tube heaters. The auxiliary heater 610 is disposed, for example, so as to be able to start reheating of sheet P from a position 20 mm away from the nip portion of the fixing unit 60.

The MFP 500 further includes a first temperature sensor 621, a second temperature sensor 622, and a third temperature sensor 623. The first temperature sensor 621 detects a surface temperature of sheet P at a position (position P1) immediately before being introduced into a position facing the auxiliary heater 610. The second temperature sensor 622 detects a surface temperature of sheet P at a position (position P2) immediately after being discharged from a portion facing the auxiliary heater 610. The third temperature sensor 623 detects a surface temperature of sheet P at sheet stop position SP located on a downstream side of the auxiliary heater 610.

In the MFP 500, sheet stop position SP can be appropriately set as long as being a position which can be reached by sheet P before a toner of an image formed on sheet P is cooled to Tm by conveyance of sheet P at a normal conveying rate. Tm is a temperature at which a storage elastic modulus of a toner constituting an image on sheet P is $10^6$ Pa.

In an example, sheet stop position SP is located 100 mm downstream from an exit of the auxiliary heater 610. The third temperature sensor 623 is installed so as to detect the temperature of sheet P located 100 mm downstream from the exit of the auxiliary heater 610. A sheet conveyance mechanism of the MFP 500 (for example, a mechanism included in the image forming unit 200 described later) may temporarily stop sheet P at sheet stop position SP in order to detect the temperature of sheet P.

Using a detected temperature and a detection timing by the second temperature sensor 622 and a detected temperature and a detection timing by the third temperature sensor 623, the MFP 500 may estimate a time point (time point TD described later) when the temperature of sheet P reaches Tm (or has reached Tm). As a result, sheet stop position SP can be set irrespective of a position at which the temperature of sheet P reaches Tm. The MFP 500 may further use a detected temperature and a detection timing by the first temperature sensor 621 to estimate a time point when the sheet reaches Tm (or has reached Tm). The MFP 500 may use a detected temperature and a detection timing by the first temperature sensor 621 in place of using a detected temperature and a detection timing by the second temperature sensor 622 to estimate a time point when the sheet reaches Tm (or has reached Tm).

The MFP 500 further includes a cooling fan 630. The cooling fan 630 faces the auxiliary heater 610 via the conveying path 3. That is, in the MFP 500, the cooling fan 630 cools a surface on one side of sheet P in which a surface on the other side is heated by the auxiliary heater 610.

[3] Hardware Configuration of MFP

FIG. 3 is a diagram schematically illustrating a hardware configuration of the MFP 500.

As illustrated in FIG. 3, the control unit 100 includes a central processing unit (CPU) 101, a read only memory (ROM) 102, and a random access memory (RAM) 103. The CPU 101 reads a program corresponding to processing contents from the ROM 102, develops the program in the RAM 103, and cooperates with the developed program to control an operation of each block of the MFP 500. At this time, the CPU 101 refers to various kinds of data stored in a storage 72. The storage 72 is constituted by, for example, a nonvolatile semiconductor memory (so-called flash memory) and/or a hard disk drive.

The control unit 100 exchanges various kinds of data with an external device (for example, a personal computer) connected to a communication network such as a local area network (LAN) or a wide area network (WAN) via a communication unit 71. For example, the control unit 100 receives image data transmitted from an external device, and forms an image on sheet P based on the image data. The communication unit 71 is constituted by a communication control card such as a LAN card.

The scanner unit 800 includes an ADF 900 (refer to FIG. 1) and a scanner. The ADF 900 conveys a document placed on a document tray with a conveyance mechanism and sends the document to a document image scanning device 12. The scanner can read images of a large number of documents D (including both surfaces) placed on the document tray in succession at once.

The scanner of the scanner unit 800 optically scans a document conveyed onto a contact glass from the ADF 900 or a document placed on the contact glass, forms an image of reflected light from the document on a light receiving surface of a charge coupled device (CCD) sensor, and reads the document image. The scanner unit 800 generates image data based on the reading result by the scanner. This image data is subjected to a predetermined image process in an image processing unit 310.

An operation panel 300 is implemented by, for example, a unit with a touch panel, and functions as a display unit 301 and an operation unit 302. The display unit 301 is implemented by, for example, a liquid crystal display (LCD), and displays various operation screens, an image status, operation conditions of functions, and the like according to a display control signal input from the control unit 100. The operation unit 302 is implemented by various operation keys such as a ten key and a start key, and a touch sensor in a touch panel. The operation unit 302 accepts various input operations by a user and outputs an operation signal to the control unit 100.

The image processing unit 310 includes, for example, a circuit that performs a digital image process depending on initial setting or user setting for image data. For example, under control of the control unit 100, the image processing unit 310 performs tone correction based on tone correction data (tone correction table), and executes various kinds of processes (including various kinds of correction processes such as tone correction, color correction, and shading correction, and a compression process) on input image data. The control unit 100 controls the image forming unit 200 based on image data that has been subjected to these processes.

In the fixing unit 60, the fixing roller motor 61, the pressurizing roller motor 62, and the heater 63 are controlled by the control unit 100. The temperature sensor 64 is disposed on a surface of the fixing belt 605. The temperature sensor 64 outputs each detection output to the control unit 100.

The control unit 100 controls the auxiliary heater 610 and the cooling fan 630. The control unit 100 acquires a detected temperature from each of the first temperature sensor 621, the second temperature sensor 622, and the third temperature sensor 623.

[4] Preparation of Toner

A method for preparing a toner used for image formation in the MFP 500 will be described.

[4-1] Base Particles of Toner

A toner used in the MFP 500 contains at least a binder resin and a wax as toner base particles. Each of the binder resin and the wax will be described below.

[4-1-1] Binder Resin

The kind of the binder resin constituting the toner particles is not particularly limited. That is, the binder resin constituting the toner particles can be achieved by various substances known as a binder resin. Examples of the binder resin include a styrene resin, an acrylic resin, a styrene-acrylic resin, a polyester resin, a silicone resin, an olefin resin, an amide resin, and an epoxy resin.

The binder resin preferably contains a styrene-acrylic resin from viewpoints of a toner particle diameter, shape controllability, and chargeability. A polymerizable monomer for obtaining the styrene-acrylic resin is, for example, a styrene-based monomer such as styrene, methylstyrene, methoxystyrene, butylstyrene, phenylstyrene, and/or chlorostyrene. The monomer may be a (meth)acrylate-based monomer such as methyl (meth)acrylate, ethyl (meth)acrylate, butyl (meth)acrylate, or ethylhexyl (meth)acrylate. The monomer may be a carboxylic acid-based monomer such as acrylic acid, methacrylic acid, or fumaric acid. Of these monomers, only one kind may be adopted, or two or more kinds may be combined.

The glass transition point (Tg) of the binder resin is preferably 30 to 50° C., and more preferably 35 to 48° C. With the glass transition point of the binder resin within the above range, both low-temperature fixability and heat-resistant storage stability are obtained. The glass transition point of the binder resin is measured, for example, using "Diamond DSC" (manufactured by Perkin Elmer Co., Ltd.).

As a measuring procedure, for example, 3.0 mg of a sample (binder resin) is enclosed in an aluminum pan, and the aluminum pan is set in a holder. An empty aluminum pan is used as a reference. As measurement conditions, for example, a measurement temperature is 0° C. to 200° C., a temperature rising rate is 10° C./min, and a temperature falling rate is 10° C./min. Heat-cool-heat temperature control is executed. Data acquired in second heat in the temperature control is used for analysis. An intersection between an extension line of a baseline before a first endothermic peak rises and an assumed tangent indicating a maximum inclination in a region from the first peak rising portion to a peak apex is an example of the glass transition point.

[4-1-2] Wax

In the MFP 500, a wax known as a wax contained in a toner can be adopted. Examples of the wax include: a polyolefin wax such as a polyethylene wax or a polypropylene wax; and a branched chain hydrocarbon wax such as a microcrystalline wax. The wax may be: a long chain hydrocarbon-based wax such as a paraffin wax or a sazol wax; a dialkyl ketone-based wax such as distearyl ketone; an ester-based wax such as a carnauba wax, a montan wax, behenyl behenate, trimethylolpropane tribehenate, pentaerythritol tetrabehenate, pentaerythritol diacetate dibehenate, glycerin tribehenate, 1,18-octadecanediol distearate, tristearyl trimellitate, or distearyl maleate; or an amide-based wax such as ethylenediamine behenylamide or tristearylamide trimellitate. Among these substances, a branched chain hydrocarbon wax such as a microcrystalline wax is particularly preferable from a viewpoint of suppressing gloss unevenness.

The melting point of a wax contained in the toner is preferably 70 to 100° C., and more preferably 70 to 85° C. The melting point of the wax indicates the temperature of a peak top of an endothermic peak. DSC measurement is performed by differential scanning calorimetric analysis using a differential scanning calorimeter "DSC-7" (manufactured by Perkin Elmer Co., Ltd.) and a thermal analyzer controller "TAC7/DX" (manufactured by Perkin Elmer Co., Ltd.).

In an example of the measurement, specifically, 4.5 mg of a sample (wax) is enclosed in an aluminum pan (KIT NO. 0219-0041). This aluminum pan is set in a sample holder of "DSC-7". Temperature control of heating-cooling-heating is performed under measurement conditions in which a measurement temperature is 0 to 200° C., a temperature rising rate is 10° C./min, and a temperature falling rate is 10° C./min. Data acquired by the second heating in the temperature control is to be analyzed. In measurement of a reference, for example, an empty aluminum pan is used.

The content of the wax is preferably 1 to 30 parts by mass, and more preferably 5 to 20 parts by mass relative to 100 parts by mass of the binder resin. The content ratio of the wax within the above range makes it possible to obtain fixing separability.

[4-2] Colorant

In a case where the toner particles contain a colorant, a dye and a pigment generally known can be used as the colorant.

Examples of a colorant for obtaining a black toner include various known colorants, for example, a carbon black such as furnace black or channel black, a magnetic substance such as magnetite or ferrite, a dye, and an inorganic pigment including non-magnetic iron oxide.

As a colorant for obtaining a color toner, a known colorant such as a dye or an organic pigment can be arbitrarily used. Specific examples of the organic pigment include C.I. Pigment Red 5, C.I. Pigment Red 48:1, C.I. Pigment Red 53:1, C.I. Pigment Red 57:1, C.I. Pigment Red 81:4, C.I. Pigment Red 122, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, C.I. Pigment Red 238, C.I. Pigment Red 269, C.I. Pigment Yellow 14, C.I. Pigment Yellow 17, C.I. Pigment Yellow 74, C.I. Pigment Yellow 93, C.I. Pigment Yellow 94, C.I. Pigment Yellow 138, C.I. Pigment Yellow 155, C.I. Pigment Yellow 180, C.I. Pigment Yellow 185, C.I. Pigment Orange 31, C.I. Pigment Orange 43, C.I. Pigment Blue 15:3, C.I. Pigment Blue 60, and C.I. Pigment Blue 76. Examples of the dye include C.I. Solvent Red 1, C.I. Solvent Red 49, C.I. Solvent Red 52, C.I. Solvent Red 58, C.I. Solvent Red 68, C.I. Solvent Red 11, C.I. Solvent Red 122, C.I. Solvent Yellow 19, C.I. Solvent Yellow 44, C.I. Solvent Yellow 77, C.I. Solvent Yellow 79, C.I. Solvent Yellow 81, C.I. Solvent Yellow 82, C.I. Solvent Yellow 93, C.I. Solvent Yellow 98, C.I. Solvent Yellow 103, C.I. Solvent Yellow 104, C.I. Solvent Yellow 112, C.I. Solvent Yellow 162, C.I. Solvent Blue 25, C.I. Solvent Blue 36, C.I. Solvent Blue 69, C.I. Solvent Blue 70, C.I. Solvent Blue 93, and C.I. Solvent Blue 95.

The above-described colorants for obtaining a toner of each color may be used singly or in combination of two or more kinds thereof for each color.

The content of the colorant is preferably 1 to 10 parts by mass, and more preferably 2 to 8 parts by mass relative to 100 parts by mass of the binder resin.

[4-3] Charge Control Agent

In a case where the toner particles contain a charge control agent, a known positive or negative charge control agent may be used.

Specific examples of the positive charge control agent include a nigrosine-based dye such as "Nigrosine Base EX" (manufactured by Orient Chemical Industries, Ltd.), a quaternary ammonium salt such as "quaternary ammonium salt P-51" (manufactured by Orient Chemical Industries Ltd.) or Copy Charge PXVP435 (manufactured by Hoechst Japan), an alkoxylated amine, an alkylamide, a molybdic acid chelate pigment, and an imidazole compound such as "PLZ1001" (manufactured by Shikoku Chemicals Corporation).

Specific examples of the negative charge control agent include a metal complex such as "Bontron S-22" (manufactured by Orient Chemical Industries, Ltd.), "Bontron S-34" (manufactured by Orient Chemical Industries, Ltd.), "Bontron E-81" (manufactured by Orient Chemical Industries Ltd.), "Bontron E-84" (manufactured by Orient Chemical Industries, Ltd.), or "Spiron Black TRH" (manufactured by Hodogaya Chemical Co., Ltd.), a thioindigo-based pigment, a quaternary ammonium salt such as "Copy Charge NXVP434" (manufactured by Hoechst Japan), a calixarene compound such as "Bontron E-89" (manufactured by Orient Chemical Industries, Ltd.), a boron compound such as "LR147" (manufactured by Japan Carlit Co., Ltd.), and a fluoride compound such as magnesium fluoride or carbon fluoride. Specific examples of the metal complex used as the negative charge control agent include, in addition to those illustrated above, an oxycarboxylic acid metal complex, a dicarboxylic acid metal complex, an amino acid metal complex, a diketone metal complex, a diamine metal complex, an azo group-containing benzene-benzene derivative skeleton metal body, and an azo group-containing benzene-naphthalene derivative skeleton metal complex.

The content of the charge control agent is preferably 0.01 to 30 parts by mass, and more preferably 0.1 to 10 parts by mass relative to 100 parts by mass of the binder resin.

[4-4] External Additive

An external additive may be added to the toner from a viewpoint of improving fluidity, chargeability, cleaning performance, and the like.

The external additive is formed of, for example, inorganic fine particles. Examples of the inorganic fine particles include: inorganic oxide fine particles such as silica fine particles, alumina fine particles, or titanium oxide fine particles; inorganic stearic acid compound fine particles such as aluminum stearate fine particles or zinc stearate fine particles; and inorganic titanic acid compound fine particles such as strontium titanate or zinc titanate.

The above-described inorganic fine particles have been preferably surface-treated with a silane coupling agent, a titanium coupling agent, a higher fatty acid, silicone oil, or the like from viewpoints of heat-resistant storage stability and environmental stability.

The inorganic fine particles constituting the external additive preferably have an average primary particle diameter of 30 nm or less. Due to the above particle diameter of the external additive constituted by the inorganic fine particles, the external additive is hardly released at the time of image formation of the toner. The amount of the external additive added is 0.05 to 5% by mass, and preferably 0.1 to 3% by mass in the toner.

[4-5] Developer

The toner used in the MFP 500 can be used as a magnetic or non-magnetic one-component developer, but may be used as a two-component developer by being mixed with a carrier.

In a case where the toner is used as a two-component developer, examples of the carrier include magnetic particles formed of a conventionally known material. The magnetic particles are formed of, for example, a ferromagnetic metal such as iron, an alloy of a ferromagnetic metal, aluminum, lead, and the like, or a ferromagnetic metal compound such as ferrite or magnetite, and are particularly preferably ferrite particles.

The carrier is, for example, a coated carrier obtained by coating surfaces of magnetic particles with a coating agent such as a resin, or a binder type carrier obtained by dispersing a magnetic fine powder in a binder resin.

The coating resin constituting the coated carrier is not particularly limited. Examples of the coating resin include an olefin-based resin, a styrene-based resin, a styrene-acrylic resin, a silicone-based resin, an ester resin, and/or a fluorine resin.

The resin constituting the resin dispersion type carrier is not particularly limited. Examples of the resin constituting the resin dispersion type carrier include a styrene-acrylic resin, a polyester resin, a fluorine resin, and/or a phenol resin.

In a case where the toner is used as a two-component developer in the MFP 500, for example, the two-component developer can be adjusted by further adding, if necessary, a charge control agent, an adhesion improver, a primer treatment agent, a resistance control agent, and the like to the toner and the carrier.

[4-6] Average Particle Diameter of Toner Particles

The toner particles used in the MFP 500 have an average particle diameter preferably of 3 to 9 μm, more preferably of 3 to 8 μm in terms of a volume-based median diameter. For example, in a case where the toner particles are manufactured according to an emulsion aggregation method described below, the particle diameter can be controlled by the concentration of a flocculant used, the amount of an organic solvent added, fusion-bonding time, and/or the composition of a polymer.

The volume-based median diameter within the above-described range enhances transfer efficiency, thereby improves the image quality of halftone in an image formed on sheet P, and further improves the image quality of a thin line and a dot.

The volume-based median diameter of the toner particles can be determined and calculated, for example, by using a measuring apparatus connected to a computer system having data processing software "Software V3.51" mounted on "Multisizer 3" (manufactured by Beckman Coulter, Inc.).

Specifically, 0.02 g of a sample (toner particles) is added to 20 mL of a surfactant solution (for the purpose of dispersing the toner particles, for example, a surfactant solution obtained by diluting a neutral detergent containing a surfactant component 10 times with pure water). Thereafter, the sample to which the surfactant solution has been added is ultrasonically dispersed for one minute to prepare a toner particle dispersion. This toner particle dispersion is poured into a beaker containing "ISOTON II" (manufactured by Beckman Coulter, Inc.) in a sample stand, for example, with a pipette until a display concentration of the measuring apparatus reaches 8%. By adjusting the concentration to the concentration range, a reproducible measurement value can be obtained. Thereafter, in the measuring apparatus, the count number of measurement particles is set to 25000, and an aperture diameter is set to 50 μm. A range of 1 to 30 μm, which is a measurement range, is divided into 256 parts, a frequency value is calculated, and a particle diameter of 50% from a side with a larger volume accumulated fraction is specified as a volume-based median diameter of the toner particles.

[4-7] Average Circularity of Toner Particles

The toner particles used in the MFP 500 have an average circularity preferably of 0.930 to 1.000, more preferably of 0.950 to 0.995 from a viewpoint of improving transfer efficiency. The average circularity of the toner particles is measured, for example, using "FPIA-2100" (manufactured by Sysmex Corporation).

Specifically, for example, a sample (toner particles) is put in an aqueous solution containing a surfactant, and then the resulting solution is ultrasonically dispersed for one minute. As a result, the toner particles are dispersed in the aqueous solution. Thereafter, the resulting solution is photographed using "FPIA-2100" (manufactured by Sysmex Corporation) under measurement conditions: HPF (high magnification imaging) mode at an appropriate concentration of 3,000 to 10,000 HPF detection numbers. As a result, circularity is calculated for each of the toner particles according to the following formula (T).

Circularity=(peripheral length of circle having the same projected area as particle image)/(peripheral length of particle projected image) formula (T)

The average circularity is calculated, for example, by dividing a value obtained by adding the circularity of each of the toner particles by the total number of toner particles.

[4-8] Toner Storage Elastic Modulus

Viscoelastic properties of the toner used in the MFP 500 are measured using, for example, a viscoelasticity measuring apparatus (rheometer) "RDA-II type" (manufactured by Rheometrics Co., Ltd.). An example of measurement conditions is illustrated below.

Measurement jig: A parallel plate having a diameter of 10 mm is used.

Measurement sample: A toner is heated and melted, and then is formed into a cylindrical sample having a diameter of about 10 mm and a height of 1.5 to 2.0 mm to be used.

Measurement frequency: 6.28 rad/s

Setting measurement distortion: An initial value is set to 0.1%, and measurement is performed in an automatic measurement mode.

Elongation correction of sample: Adjustment is performed in an automatic measurement mode.

[4-9] Toner Softening Point

The softening point (Tsp) of the toner used in the MFP 500 is preferably 90 to 110° C. The softening point (Tsp) within the above range can reduce an influence of heat applied to the toner at the time of fixing. This makes it possible to form an image without imposing a burden on a colorant. Therefore, it is expected to develop wider and more stable color reproducibility.

The softening point (Tsp) of the toner can be controlled, for example, by any one of the following methods (m1) to (m3) or in combination thereof.

(m1) Adjust the kind of a polymerizable monomer to form a binder resin and a composition ratio thereof.

(m2) Adjust the molecular weight of a binder resin according to the kind of a chain transfer and the amount thereof added.

(m3) Adjust the kind of a wax or the like and the amount thereof added.

The softening point (Tsp) of the toner is measured using, for example, "Flow tester CFT-500" (manufactured by Shimadzu Corporation). In the measurement, the toner is formed into a columnar shape having a height of 10 mm. A measuring machine applies a pressure of $1.96\times10^6$ Pa from a plunger while heating the toner at a temperature rising rate of 6° C./min and extrudes the toner from a nozzle having a diameter of 1 mm and a length of 1 mm. As a result, the measuring machine draws a curve (softening flow curve) between plunger drop amount of the flow tester and temperature. In an example, a first outflow temperature is specified as a melt starting temperature. A temperature for the drop amount of 5 mm is specified as a softening point temperature.

[4-10] Method for Manufacturing Toner

Examples of a method for manufacturing a toner include a kneading/grinding method, an emulsification dispersion method, a suspension polymerization method, a dispersion polymerization method, an emulsion polymerization method, an emulsion polymerization aggregation method, a miniemulsion polymerization aggregation method, an encapsulation method, and another known method. Considering that it is necessary to obtain a toner having a small particle diameter in order to attain a high image quality of an image as the method for manufacturing a toner, the emulsion polymerization aggregation method is adopted from viewpoints of manufacturing cost and manufacturing stability. In the emulsion polymerization aggregation method, a dispersion of fine particles (hereinafter, also referred to as "binder resin fine particles") formed of a binder resin manufactured by an emulsion polymerization method is mixed with a dispersion of fine particles (hereinafter, also referred to as "colorant fine particles") formed of a colorant. Aggregation is slowly performed while a repulsive force of surfaces of the fine particles due to adjustment of a pH value is balanced with a cohesive force due to addition of a coagulant formed of an electrolyte, and association is performed while an average particle diameter and a particle size distribution are controlled. At the same time, heating and stirring are performed to fusion-bond the fine particles, and the shapes of the fine particles are controlled to manufacture a toner.

In a case where the emulsion polymerization aggregation method is adopted as a method for manufacturing a toner, binder resin fine particles are formed. The binder resin fine particles may have two or more layers formed of binder resins having different compositions. In this case, a method for adding a polymerization initiator and a polymerizable monomer to a dispersion of first binder resin fine particles prepared by an emulsion polymerization process (first stage polymerization) according to a conventional method, and subjecting this system to a polymerization process (second stage polymerization) may be adopted.

The toner may have a core-shell structure. In a method for manufacturing a toner having a core-shell structure, first, core binder resin fine particles and colorant fine particles are associated, aggregated, and fusion-bonded to prepare core particles. Thereafter, in order to form a shell layer in the dispersion of core particles, shell binder resin fine particles are added to the core particles. As a result, shell binder resin fine particles are aggregated and fusion-bonded to surfaces of the core particles to form shell layers coating the surfaces of the core particles.

A specific example of a method for manufacturing a toner when the toner has a core-shell structure will be described. The method for manufacturing a toner includes the following (step 1) to (step 8).

(Step 1) Colorant fine particle dispersion preparing step of preparing a dispersion of colorant fine particles in which a colorant is dispersed in a form of fine particles (Step 2-1) Core binder resin fine particle polymerizing step of obtaining core binder resin fine particles formed of a core binder resin containing a main wax, an internal additive, and the like and preparing a dispersion of the fine particles (Step 2-2) Shell binder resin fine particle polymerizing step of obtaining shell binder resin particles formed of a shell binder resin, and then preparing a dispersion of the fine particles (Step 3) Aggregation/fusion-bonding step of aggregating and fusion-bonding core binder resin fine particles and colorant fine particles in an aqueous medium to form associated particles to be core particles (Step 4) First aging step of controlling the shapes of the associated particles by aging the associated particles with thermal energy to obtain core particles (Step 5) Shell layer forming step of adding shell binder resin fine particles to form a shell layer to a dispersion of the core particles and thereby aggregating and fusion-bonding the shell binder resin fine particles to surfaces of the core particles to form particles each having a core-shell structure (Step 6) Second aging step of aging the particles each having a core-shell structure with thermal energy and thereby controlling the shapes of the particles to obtain toner particles each having a core-shell structure (Step 7) Filtration and cleaning step of separating the toner particles from a dispersion system (aqueous medium) of the cooled toner particles by solid-liquid separation and removing a surfactant and the like from the toner particles (Step 8) Drying step of drying the cleaned toner particles The method for manufacturing a toner includes the following (step 9) after the drying step (step 8), if necessary.

(Step 9) External additive processing step of adding an external additive to dried toner particles The contents of each of the steps will be described below.

(Step 1) Colorant Fine Particle Dispersion Preparing Step

In this step, by adding a colorant to an aqueous medium and dispersing the colorant with a dispersing machine, a dispersion of colorant fine particles in which the colorant is dispersed in a form of fine particles is prepared. Specifically, the colorant is dispersed in an aqueous medium in which the concentration of a surfactant is equal to or higher than a critical micelle concentration (CMC). A dispersing machine used for the dispersion process is not particularly limited, but is preferably an ultrasonic dispersing machine, a mechanical homogenizer, a pressurizing dispersing machine such as a Manton Gaulin or a pressure type homogenizer, a sand grinder, or a medium type dispersing machine such as a Getzmann mill or a diamond fine mill.

The dispersion diameter of each of the colorant fine particles in the colorant fine particle dispersion is preferably 40 to 200 nm in terms of a volume-based median diameter.

The volume-based median diameter of each of the colorant fine particles is measured, for example, using "MICROTRACUPA-150 (manufactured by HONEYWELL)". Measurement conditions are, for example, as follows.

Sample refractive index: 1.59

Sample specific gravity: 1.05 (in terms of spherical particles)

Solvent refractive index: 1.33

Solvent viscosity: 0.797 (30° C.), 1.002 (20° C.)

For example, deionized water is put in a 0-point adjustment measurement cell.

(Step 2-1) Core Binder Resin Fine Particle Polymerizing Step

This step includes a process for preparing a dispersion of core binder resin fine particles formed of a core binder resin containing a main wax, an internal additive, and the like by performing a polymerization process.

In a preferable example of the polymerization process in this step, a polymerizable monomer solution containing a main wax, an internal additive, and the like, if necessary, is added to an aqueous medium containing a surfactant having a concentration equal to or lower than a critical micelle concentration (CMC), mechanical energy is applied to the solution to form droplets, and then a water-soluble polymerization initiator is added thereto to cause a polymerization reaction in the droplets.

An oil-soluble polymerization initiator may be added to the droplets. In such a step, it is essential to perform forced emulsification (formation of droplets) by applying mechanical energy.

The above-described mechanical energy is applied by, for example, a homomixer, ultrasonic waves, or an apparatus for applying strong stirring or ultrasonic vibration energy, such as Manton Gaulin.

[Surfactant]

A surfactant used in an aqueous medium used as the colorant fine particle dispersion or in an aqueous medium used as a medium for polymerizing core binder resin fine particles will be described.

The surfactant is not particularly limited, but examples thereof include an ionic surfactant such as a sulfonate (sodium dodecylbenzenesulfonate or sodium arylalkyl polyether sulfonate), a sulfate (sodium dodecyl sulfate, sodium tetradecyl sulfate, sodium pentadecyl sulfate, or sodium octyl sulfate), or a fatty acid salt (sodium oleate, sodium laurate, sodium caprate, sodium caprylate, sodium caproate, potassium stearate, or calcium oleate). The surfactant may be a nonionic surfactant such as polyethylene oxide, polypropylene oxide, a combination of polypropylene oxide and polyethylene oxide, an ester of polyethylene glycol and a higher fatty acid, alkylphenol polyethylene oxide, an ester of a higher fatty acid and polyethylene glycol, an ester of a higher fatty acid and polypropylene oxide, or a sorbitan ester.

Hereinafter, a polymerization initiator and a chain transfer agent used in the core binder resin fine particle polymerizing step will be described.

[Polymerization Initiator]

Example of the water-soluble polymerization initiator include a persulfate such as potassium persulfate or ammonium persulfate, azobisaminodipropane acetate, azobiscyanovaleric acid and a salt thereof, and hydrogen peroxide.

Example of the oil-soluble polymerization initiator include: an azo-based or diazo-based polymerization initiator such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, or azobisisobutyronitrile; and a peroxide-based polymerization initiator or a polymer initiator having a peroxide in a side chain, such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexyl) propane, or tris-(t-butylperoxy) triazine.

[Chain Transfer Agent]

In the present embodiment, in order to adjust the molecular weight of a core binder resin to be obtained, a generally used chain transfer agent can be used. The chain transfer agent is not particularly limited, and examples thereof include: a mercaptan such as n-octyl mercaptan, n-decyl mercaptan, or tert-dodecyl mercaptan; a mercaptopropionate such as n-octyl-3-mercaptopropionate, terpinolene, and an α-methylstyrene dimer.

(Step 2-2) Shell Binder Resin Fine Particle Polymerizing Step

This step includes, for example, a polymerization process and a process for preparing a dispersion of shell binder resin fine particles formed of a shell binder resin, similar to the above core binder resin fine particle polymerizing step (step 2-1).

(Step 3) Aggregation/Fusion-Bonding Step

This step includes a process for forming associated particles to be core particle by aggregating and fusion-bonding core binder resin fine particles and colorant fine particles in an aqueous medium. A method for aggregation and fusion-bonding in this step is preferably a salting-out/fusion-bonding method, for example, using colorant fine particles obtained in (step 1) and core binder resin fine particles obtained in (step 2-1).

In this step (step 3), aggregation/fusion-bonding of wax fine particles and/or internal additive fine particles such as a charge control agent may be performed together with core binder resin fine particles and colorant fine particles.

"Salting-out/fusion-bonding" refers to a process for performing aggregation and fusion-bonding in parallel, adding an aggregation stopper to stop growth of particles when the particles grow to have desired particle diameters, and further heating the resulting product continuously in order to control the shapes of the particles, if necessary.

The salting-out/fusion-bonding method is a method in which a salting-out agent including an alkali metal salt or an alkaline earth metal salt, a trivalent salt, or the like is added to an aqueous medium containing core binder resin fine particles and colorant fine particles as a coagulant having a concentration equal to or higher than a critical aggregation concentration, and then the resulting mixture is heated to a temperature equal to or higher than the glass transition point of the core binder resin fine particles and equal to or higher than the melting peak temperature of the core binder resin fine particles and the colorant fine particles to perform salting-out and aggregation/fusion-bonding at the same time. A metal included in each of the alkali metal salt and the alkaline earth metal salt which are salting-out agents may be an alkali metal (lithium, potassium, sodium, or the like) or an alkaline earth metal (magnesium, calcium, strontium, barium, or the like). The metal is preferably potassium, sodium, magnesium, calcium, or barium.

In a case where the aggregation/fusion-bonding step (step 3) is performed by salting out/fusion-bonding, leaving time after addition of the salting-out agent is preferably as short as possible. A reason for this is not clear, but as the reason, for example, an aggregation state of particles varies depending on the leaving time after salting-out, a particle diameter distribution may be unstable, or a surface property of a fusion-bonded toner may vary disadvantageously. A temperature at which the salting-out agent is added is required to be at least equal to or lower than the glass transition point of the core binder resin fine particles. A reason for this is as follows. That is, if the temperature at which the salting-out agent is added is equal to or higher than the glass transition point of the core binder resin fine particles, salting out/fusion-bonding of the core binder resin fine particles proceeds rapidly. Meanwhile, a particle diameter cannot be controlled, and particles having large particle diameters are generated disadvantageously. A range of the addition temperature only needs to be equal to or lower than the glass transition point of the binder resin, but is generally 5 to 55° C., and preferably 10 to 45° C.

The salting-out agent is added at a temperature equal to or lower than the glass transition point of the core binder resin fine particles. Thereafter, the temperature of the resulting mixture is raised as rapidly as possible, and the mixture is heated to a temperature equal to or higher than the glass transition point of the core binder resin fine particles and equal to or higher than the melting peak temperature (° C.) of the core binder resin fine particles and the colorant fine particles. The time before rising the temperature is preferably less than one hour. Furthermore, it is necessary to rapidly raise the temperature, but a temperature rising rate is preferably 0.25° C./min or more. An upper limit thereof is not particularly clear. However, salting-out drastically proceeds when the temperature is instantaneously raised. Therefore, it is difficult to control a particle diameter disadvantageously, and the temperature rising rate is preferably 5° C./min or less. By the salting-out/fusion-bonding method described above, a dispersion of associated particles (core particles) obtained by salting out/fusion-bonding core binder resin fine particles and arbitrary fine particles is obtained.

"Aqueous medium" refers to a medium containing 50 to 100% by mass of water and 0 to 50% by mass of a water-soluble organic solvent. Examples of the water-soluble organic solvent include methanol, ethanol, isopropanol, butanol, acetone, methyl ethyl ketone, and tetrahydrofuran. Among these solvents, an alcohol-based organic solvent which does not dissolve a generated resin is preferable.

(Step 4) First Aging Step

In this step, a process for aging associated particles by thermal energy is performed. By controlling the heating temperature in the aggregation/fusion-bonding step (step 3) and the heating temperature and time in the first aging step (step 4), a surface of each of the core particles formed with a constant particle diameter and a narrow distribution has a smooth and uniform shape. Specifically, in the aggregation/fusion-bonding step (step 3), progress of fusion-bonding of the core binder resin fine particles is suppressed by lowering the heating temperature to promote uniformization. In the first aging step, by lowering the heating temperature and prolonging the time, control is performed such that a surface of each of the core particles has a uniform shape.

(Step 5) Shell Layer Forming Step

In this step, a shell forming process for adding a dispersion of shell binder resin fine particles to a dispersion of core particles, aggregating and fusion-bonding the shell binder resin fine particles to surfaces of the core particles, and coating the shell binder resin fine particles to the surfaces of the core particles to form particles each having a core-shell structure is performed.

This step is a preferable manufacturing condition for imparting both low temperature fixability and heat-resistant storage stability. In a case of forming a color image, it is preferable to form this shell layer in order to obtain high color reproducibility for a secondary color.

Specifically, a dispersion of shell binder resin fine particles is added while the heating temperatures of the dispersion of the core particles in the aggregation/fusion-bonding step (step 3) and in the first aging step (step 4) are maintained. The surfaces of the core particles are slowly coated with the shell binder resin fine particles over several hours while heating and stirring are continued, and particles each having a core-shell structure are formed. The heating and stirring time is preferably 1 to 7 hours, and particularly preferably 3 to 5 hours.

(Step 6) Second Aging Step

In this step, at a stage where the particles each having a core-shell structure have obtained a predetermined particle diameter by the shell layer forming step (step 5), a stopper such as sodium chloride is added to stop the growth of the particles. Thereafter, heating and stirring are continued for several hours in order to fusion-bond the shell binder resin fine particles attached to the core particles. The thickness of a layer formed of the shell binder resin fine particles coating the surfaces of the core particles is set to 100 to 300 nm. In this way, the shell binder resin fine particles are fixed to the surfaces of the core particles to form shell layers, and toner particles each having a core-shell structure with a round shape and a uniform shape are formed.

(Step 7) Filtration and Cleaning Step

In this step, first, a process for cooling the dispersion of the toner particles is performed. As conditions of the cooling process, cooling is preferably performed at a cooling rate of 1 to 20° C./min. A method for the cooling process is not particularly limited, and examples thereof include a cooling method by introducing a refrigerant from the outside of a reaction vessel and a cooling method by directly putting cold water in a reaction system.

Thereafter, the toner particles are separated from the dispersion of the toner particles cooled to a predetermined temperature by solid-liquid separation. Thereafter, a cleaning process for removing deposits such as a surfactant or a salting-out agent from the solid-liquid separated toner cake (aggregate obtained by aggregating the wet toner particles in a form of a cake) is performed. Here, examples of a method for the filtration process include a centrifugal separation method, a reduced pressure filtration method using Nutsche or the like, and a filtration method using a filter press or the like, and are not particularly limited thereto.

(Step 8) Drying Step

In this step, a process for drying the cleaned toner cake is performed. Examples of a dryer used in this step include a spray dryer, a vacuum freeze dryer, and a reduced pressure dryer, and preferable examples thereof include a stationary shelf dryer, a movable shelf dryer, a fluidized bed dryer, a rotary dryer, and a stirring dryer. The water content of the dried toner particles is preferably 5% by mass or less, and more preferably 2% by mass or less.

In a case where the dried toner particles are aggregated with weak inter-particle attraction, the aggregate may be disintegrated. Here, as a disintegrating apparatus, a mechanical disintegrating apparatuses such as a jet mill, a Henschel mixer, a coffee mill, or a food processor can be used.

(Step 9) External Additive Processing Step

In this step, a process for adding an external additive to the toner particles dried in the drying step (step 8) is performed. The external additive is added, for example, using a mechanical mixing apparatus such as a Henschel mixer or a coffee mill.

[4-11] Specific Examples of Manufacturing Toner

Manufacture Example (1) of Resin Dispersion

In a reaction vessel equipped with a stirrer, a thermometer, a cooling tube, and a nitrogen gas introduction tube, 85 parts by mass of terephthalic acid, 6 parts by mass of trimellitic acid, and 250 parts by mass of bisphenol A propylene oxide adduct were put, and the inside of the reaction vessel was replaced with dry nitrogen gas. Thereafter, 0.1 parts by mass of titanium tetrabutoxide was added thereto, and the resulting mixture was stirred at about 180° C. for eight hours under a nitrogen gas flow. Furthermore, 0.2 parts by mass of titanium tetrabutoxide was added thereto, the temperature of the resulting mixture was raised to about 220° C., and the mixture was stirred for six hours. Thereafter, a reaction was performed in the reaction vessel reduced in pressure to 10 mmHg to obtain a polyester resin [A1]. The polyester resin [A1] had a glass transition point (Tg) of 59° C. and a weight average molecular weight (Mw) of 9,000.

In 200 parts by mass of ethyl acetate, 200 parts by mass of the amorphous polyester resin [A1] was dissolved. While this solution was stirred, an aqueous solution obtained by dissolving sodium polyoxyethylene lauryl ether sulfate in 800 parts by mass of deionized water so as to obtain a concentration of 1% by mass was slowly added dropwise to the solution. Ethyl acetate was removed from this solution under reduced pressure, and then the pH of the solution was adjusted to 8.5 with ammonia. Thereafter, the solid content concentration was adjusted to 20% by mass. As a result, a dispersion of fine particles of the amorphous polyester resin [A1] in which fine particles of the polyester resin [A1] were dispersed in an aqueous medium was prepared.

Manufacture Example (2) of Resin Dispersion

In a reaction vessel equipped with a stirrer, a thermometer, a cooling tube, and a nitrogen gas introduction tube, 315 parts by mass of dodecanedioic acid and 220 parts by mass of 1,6-hexanediol were put, and the inside of the reaction vessel was replaced with dry nitrogen gas. Thereafter, 0.1 parts by mass of titanium tetrabutoxide was added thereto, and the resulting mixture was stirred at about 180° C. for eight hours under a nitrogen gas flow. Furthermore, 0.2 parts by mass of titanium tetrabutoxide was added thereto, the temperature of the resulting mixture was raised to about 220° C., and the mixture was stirred for six hours. Thereafter, a reaction was performed in the reaction vessel reduced in pressure to 10 mmHg to obtain a polyester resin [B1]. The polyester resin [B1] had a melting point (Tm) of 72° C. and a weight average molecular weight (Mw) of 14,000.

Preparation Example of Wax Dispersion 200 parts by mass of Fischer-Tropsch wax "FNP-0090" (manufactured by Nippon Seiro Co., Ltd., melting point 89° C.) was heated to 95° C. to be melted. The melted wax was further added to a surfactant aqueous solution obtained by dissolving sodium alkyl diphenyl ether disulfonate in 800 parts by mass of deionized water so as to obtain a concentration of 3% by mass. Thereafter, the resulting mixture was dispersed using an ultrasonic homogenizer. The solid content concentration was adjusted to 20% by mass. As a result, a wax dispersion in which fine particles of the wax were dispersed in an aqueous medium was prepared.

Manufacture Example of Toner (1)

A toner (1) described later was manufactured as follows.

That is, 300 parts by mass of a polyester resin [A1] dispersion, 100 parts by mass of a polyester resin [B1] dispersion, 77.3 parts by mass of a wax dispersion, 41.3 parts by mass of a colorant dispersion, 225 parts by mass of deionized water, and 2.5 parts by mass of sodium polyoxyethylene lauryl ether sulfate were put in a reaction vessel equipped with a stirrer, a cooling tube, and a thermometer. While this solution was stirred, 0.1 N hydrochloric acid was added thereto to adjust the pH of the solution to 2.5.

Subsequently, 0.3 parts by mass of a polyaluminum chloride aqueous solution (10% aqueous solution in terms of $AlCl_3$) was added dropwise thereto over 10 minutes. Thereafter, while this solution was stirred, the internal temperature of the solution was raised to 60° C. Furthermore, the temperature was gradually raised to 75° C., the internal temperature was maintained at 75° C., and measurement was performed with a Coulter counter. When an average particle diameter reached the order of 6 m, 2 parts by mass of a tetrasodium 3-hydroxy-2,2'-iminodisuccinate aqueous solution (40% aqueous solution) was added to the solution to stop the growth of a particle diameter. The internal temperature was raised to 85° C. When a shape factor reached 0.96 using "FPIA-2000", the solution was cooled to room temperature at a rate of 10° C./min. This reaction solution was repeatedly filtered and cleaned, and then dried to obtain toner particles [1].

To the obtained toner particles [1], 1% by mass of hydrophobic silica (number average primary particle diameter=12 nm, degree of hydrophobicity=68) and 1% by mass of hydrophobic titanium oxide (number average primary particle diameter=20 nm, degree of hydrophobicity=63) were added, and the resulting mixture was mixed with a "HENSCHEL MIXER" (manufactured by Mitsui Miike Machinery Co., Ltd.). Thereafter, coarse particles were removed using a sieve having an opening of 45 m to obtain the toner (1).

The toner (1) had a volume-based median diameter of 6.10 m, an average circularity of 0.965, and a storage elastic modulus G' (60) of $5\times10^7$ Pa at a temperature of 60° C.

[5] Heating after Fixing Process and Glossiness of Image

Figure 4:
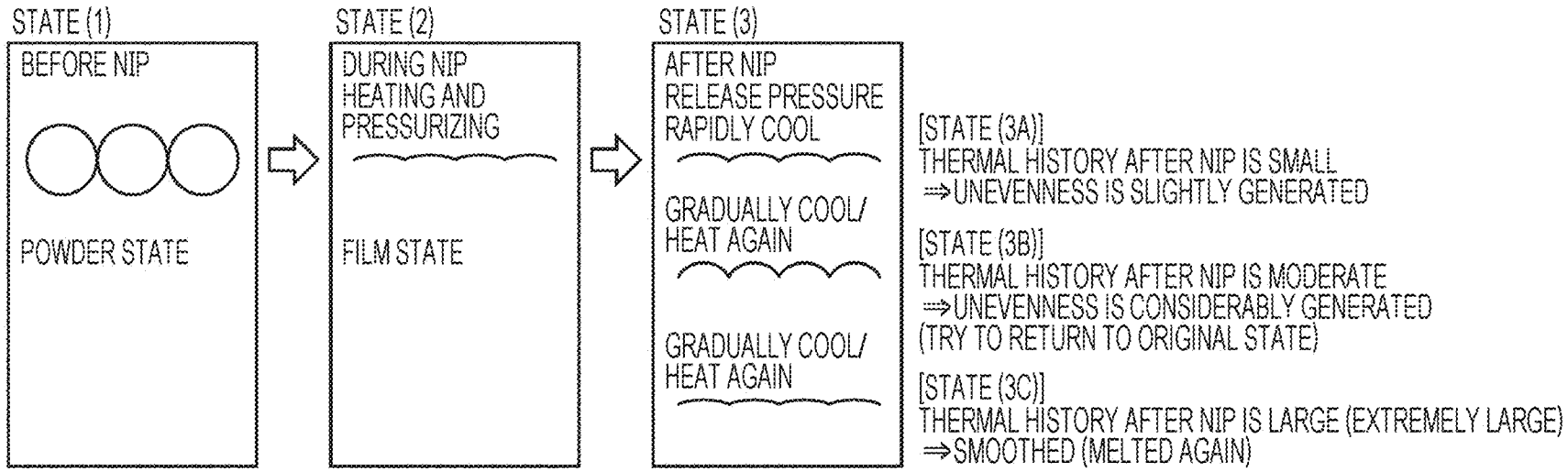
FIG. 4 is a diagram for explaining a state of a toner in an image formed on a sheet.

FIG. 4 is a diagram for explaining a state of a toner in an image formed on sheet P FIG. 4 illustrates states (1) to (3). State (1) indicates a state before a fixing process in the fixing unit 60. State (2) indicates a state during the fixing process in the fixing unit 60. State (3) indicates a state after the fixing process in the fixing unit 60.

In state (3), states (3A) to (3C) are indicated according to a thermal history of the toner after the fixing process in the fixing unit 60. State (3A) indicates a state in which the toner is rapidly cooled by being placed in a room temperature environment after the fixing process. In state (3A), unevenness is generated on a surface of the toner.

State (3B) indicates a state in which the toner is moderately heated after the fixing process. In the state (3B), moderate unevenness is generated on the surface of the toner due to elastic recovery of toner particles, and the glossiness of an image on sheet P is moderately lowered.

State (3C) indicates a state in which the toner is excessively heated after the fixing process. In state (3C), the toner is melted again, and the surface of the toner is thereby smoothed. As a result, the glossiness of the image on sheet P increases.

Here, "elastic recovery" refers to a phenomenon that in the fixing unit 60, after a predetermined pressure is applied to a toner, the toner is released from the pressure, and then the toner tries to return to an original state (powder state) in which the pressure is applied to the toner. Incidentally, as indicated by state (3A), when the toner is rapidly cooled, the toner is hardened, and therefore elastic recovery cannot be expected. Therefore, elastic recovery occurs at a temperature equal to or higher than a certain temperature (glass transition point or higher).

[6] Relationship Between Glossiness and Forming Conditions (Change in Glossiness)

Figure 5:
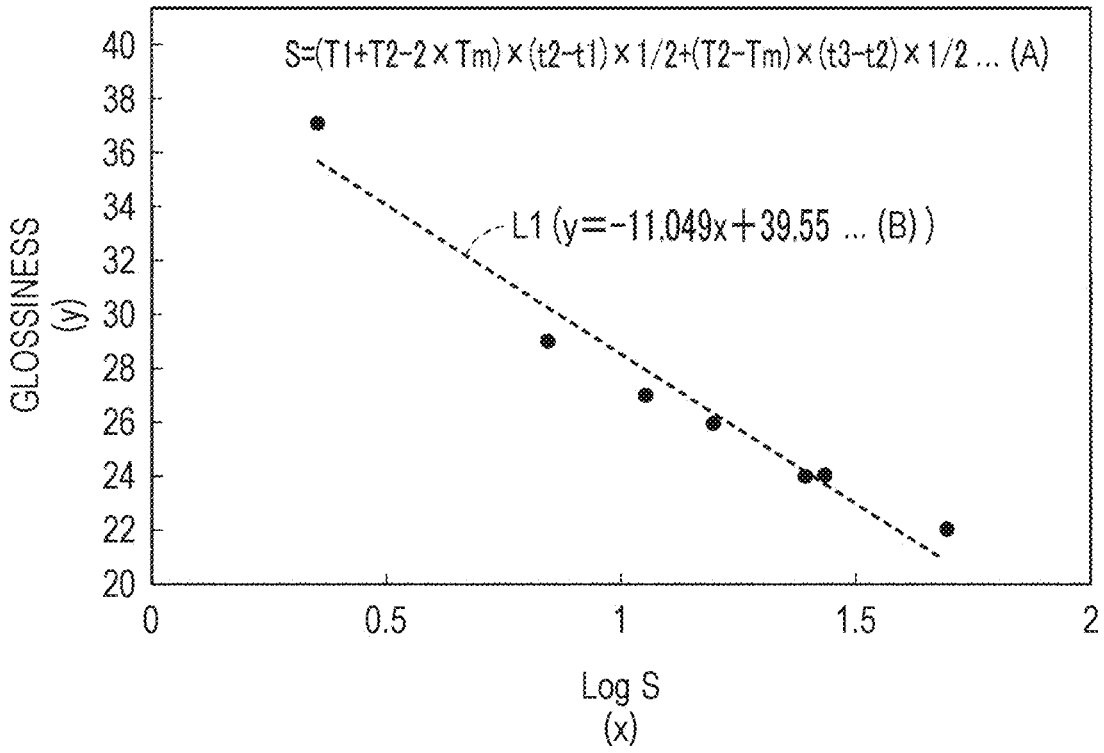
FIG. 5 is a graph illustrating an example of a relationship between a glossiness and image forming conditions in the MFP.

FIG. 5 is a graph illustrating an example of a relationship between a glossiness and image forming conditions in the MFP 500. In the graph of FIG. 5, the vertical axis (y) indicates the glossiness of an image formed on sheet P. The glossiness here is a value measured by, for example, GMX-203 (glossmeter manufactured by Murakami Color Research Laboratory Co., Ltd.). The horizontal axis (x) indicates a logarithm (Log S) of function S. The glossiness varies according to a value of Log S.

Function S is expressed by the following formula (A).

$$S=(T1+T2-2\times Tm)\times(t2-t1)\times\tfrac{1}{2}+(T2-Tm)\times(t3-t2)\times\tfrac{1}{2} \quad \text{(A)}$$

In formula (A), T1 represents a temperature measured by the first temperature sensor 621. T2 represents a temperature measured by the second temperature sensor 622. Tm is a temperature at which a storage elastic modulus of a toner constituting an image on sheet P is $10^6$ Pa. The MFP 500 uses, for example, the "toner (1)" described in the above <Manufacture Example of toner (1)> as a toner.

t1 represents time required for sheet P to move to position P1 after sheet P is discharged from the fixing unit 60. t2 represents time required for sheet P to move to position P2 after sheet P is discharged from the fixing unit 60. t3 represents time from a time point when sheet P is discharged from the fixing unit 60 to a time point when the temperature of sheet P reaches Tm. As described above, time t3 may be derived based on estimation of time point TD using a detected temperature or the like of sheet P at sheet stop position SP.

As indicated by the following formula (B), in the MFP 500, the glossiness (y) is illustrated as a function of Log S (x). Formula (B) is indicated as approximation line L1 in FIG. 5.

$$y=-11.049x+39.55 \quad (B)$$

(Explanation for Function S)

Figure 6:
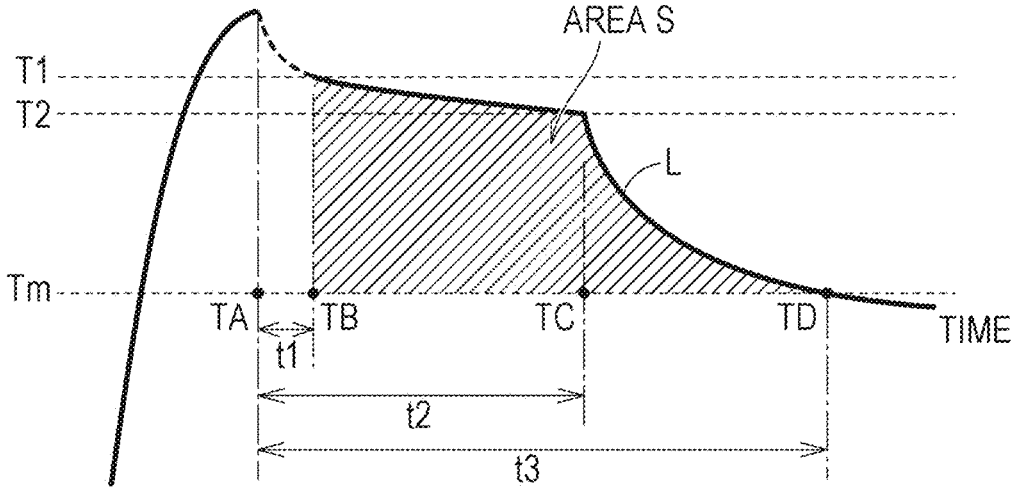
FIG. 6 is a graph for explaining meaning of function S.

FIG. 6 is a graph for explaining meaning of function S. In FIG. 6, line L represents a typical example of a temperature change of a toner on sheet P before and after the fixing process in the fixing unit 60.

In FIG. 6, time point TA represents a time point when sheet P is discharged from the fixing unit 60. Time point TB represents a time point when sheet P moves to position P1 (FIG. 2). Time point TC represents a time point when sheet P moves to position P2 (FIG. 2). Time point TD represents a time point when the temperature of sheet P reaches temperature Tm. As described above, time point TD is a time point when the temperature of sheet P is Tm (or has become Tm), estimated using a detected temperature, a detection timing, and the like by the third temperature sensor 623. Times t1, t2, and t3 in formula (A) represent a period of time from time point TA to time point TB, a period of time from time point TB to time point TC, and a period of time from time point TC to time point TD in FIG. 6, respectively.

As indicated by line L, the temperature of the toner on sheet P rises until the time reaches time point TA by being heated and fixed in the fixing unit 60. Thereafter, the temperature of the toner on sheet P is drastically lowered until sheet P reaches a position facing the auxiliary heater 610 (until time point TB). The degree of drop in temperature of the toner on sheet P is gentle from a time point when sheet P reaches a region facing the auxiliary heater 610 to a time point when sheet P exits from the region (from time point TB to time point TC). Thereafter, the temperature of the toner on sheet P is drastically lowered toward Tm after sheet P exits from the region facing the auxiliary heater 610.

The amount of heat received by the toner on sheet P after the fixing process in the fixing unit 60 is the amount of heat received after time point TA in FIG. 6. A temperature equal to or higher than temperature Tm of the toner affects a thermal history of the toner. In the present embodiment, approximation to the area of the hatched region in FIG. 6 is used as the amount of heat applied in order to heat the toner to temperature Tm or higher after time point TA. For this approximation, a value of S calculated by formula (A) is used. The formula (A) is illustrated below again.

$$S=(T1+T2-2\times Tm)\times(t2-t1)\times\tfrac{1}{2}+(T2-Tm)\times(t3-t2)\times\tfrac{1}{2} \quad (A)$$

The first three terms "(T1+T2−2×Tm)×(t2−t1)×½" on the right side of formula (A) assume that the hatched portion from time point TB to time point TC is a trapezoid. The area of the trapezoid is determined by using a perpendicular (length: T1−Tm) at time point TB as a lower base, using a perpendicular (length: T2−Tm) at time point TC as an upper base, and using a period of time from time point TB to time point TC (TC−TB) as a height.

The last two items "(T2−Tm)×(t3−t2)×½" of the right side of formula (A) assume that a region after time point TC is a triangle. The area of the triangle is determined as the area of a right-angled triangle in which a period of time from time point TC to time point TD (length: TD−TC) is a base and a difference (T2−Tm) between temperature T2 and temperature Tm is a height.

(Examples for Obtaining Approximate Line L1)

FIG. 7 is a table illustrating seven sets of concrete examples for six variables regarding a value of S. The seven sets are illustrated as examples (1) to (7), respectively. FIG. 7 illustrates values of six kinds of variables (t1, t2, t3, T1, T2, and T3), a value of S according to the six kinds of variables, and the glossiness of an image after image formation according to each example are illustrated for each of examples (1) to (7). FIG. 7 further illustrates "lighting mode of a heater" in the auxiliary heater 610. The auxiliary heater 610 includes one or more glass tube heaters. "Lighting mode of a heater" includes the number of heaters to be lit out of the one or more glass tube heaters and conditions on a surface temperature.

Figure 8:
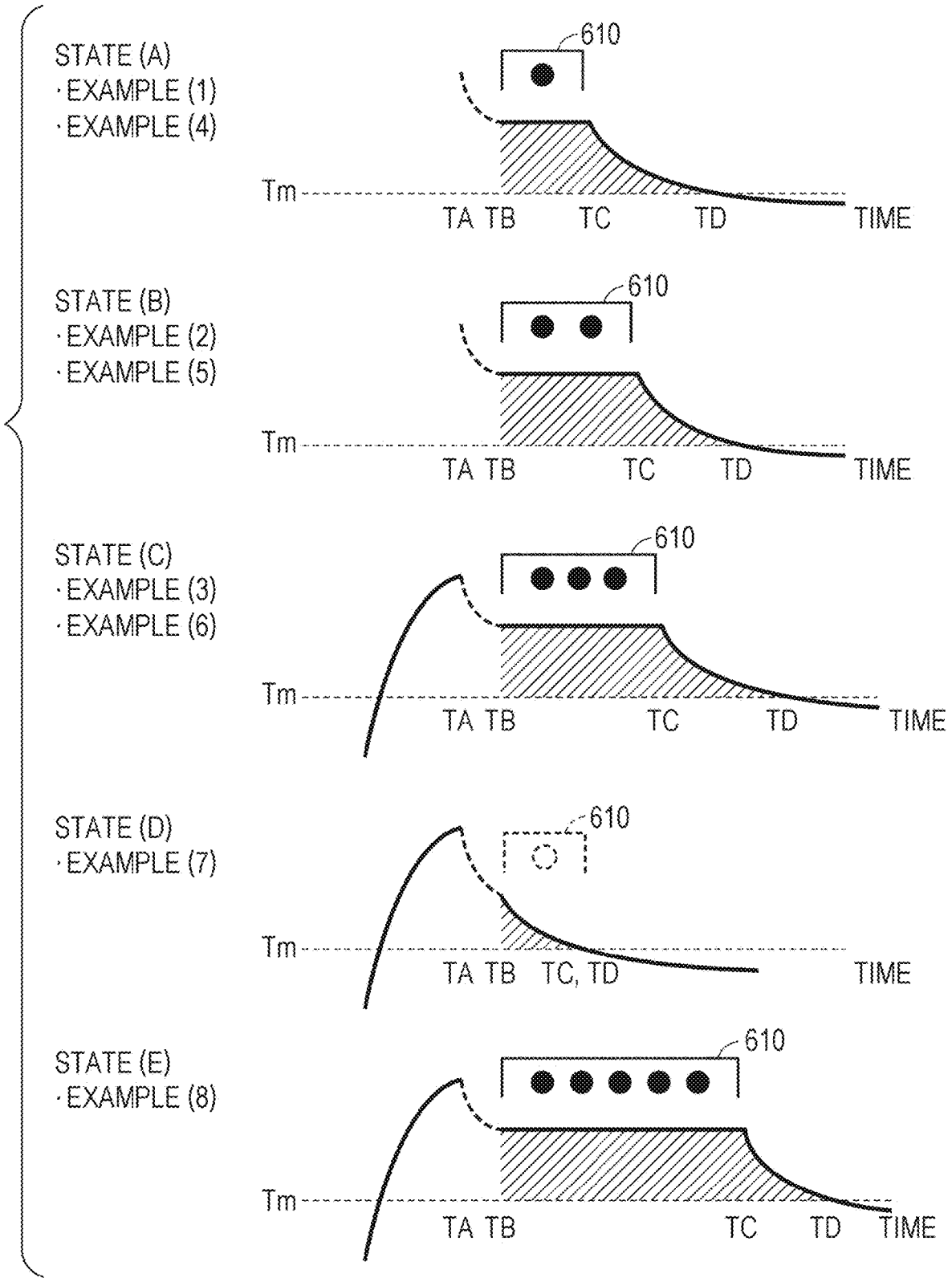
FIG. 8 is a diagram schematically illustrating five kinds of Examples for an auxiliary heater.

FIG. 8 is a diagram schematically illustrating five kinds of states of the auxiliary heater 610. In FIG. 8, state (A) corresponds to examples (1) and (4), state (B) corresponds to examples (2) and (5), state (C) corresponds to examples (3) and (6), state (D) corresponds to example (7), and state (E) corresponds to example (8). Examples (1) to (7) correspond to examples (1) to (7) in FIG. 7, respectively. Incidentally, in examples (1) to (3), the auxiliary heater 610 includes a halogen heater in which a surface temperature at the time of lighting is 100° C. In example (1), the number of heaters is one. In example (2), the number of heaters is two. In example (3), the number of heaters is three. The plurality of heaters is arranged in a conveying direction of sheet P.

In examples (4) to (6), the auxiliary heater 610 includes a halogen heater in which a surface temperature at the time of lighting is 80° C. In example (4), the number of heaters is one. In example (5), the number of heaters is two. In example (6), the number of heaters is three. In example (7), the auxiliary heater 610 is omitted.

Note that FIG. 7 and FIG. 8 illustrate example (8) in which the auxiliary heater 610 includes five halogen heaters (surface temperature at the time of lighting is 100° C.). In example (8), heating by the auxiliary heater 610 is stronger than in examples (1) to (7), and therefore the glossiness is relatively higher (glossiness=45).

(Implementation Conditions)

The glossiness illustrated in FIG. 7 was obtained under the following conditions.

The fixing belt 605 is constituted by forming a silicone rubber layer of 220 m on a polyimide substrate. In the fixing belt 605, a surface is coated with PFA. The rubber layer has a rubber hardness of 20°. The PFA coating has a layer thickness of 30 m. The rubber layer has a micro hardness (MD-1 hardness) of 85° (type C). The fixing belt has a peripheral length of 120 mm. A surface of the fixing belt 605 is set to a temperature of 180° C.

The fixing roller 602 has a rubber thickness of 20 mm, a rubber hardness of 10 degrees, and a roller diameter of 60 mm.

The heating roller 601 has a rubber thickness of 5 mm, a rubber hardness of 10 degrees, and a roller diameter of 60 mm. The rubber is a silicone rubber, and has a surface coated with a PFA resin.

The pressurizing roller 609 is set to a temperature of 80° C.

At a nip portion of the fixing unit 60, a load is 2000 N, a sheet passing rate is 300 mm/sec, and a NIP length is 20 mm. The adhesion amount of toner TN on sheet P is 8 g/m$^2$. As toner TN, the toner (1) described above is used.

The number of halogen heaters included in the auxiliary heater 610 is as illustrated in FIG. 8. In each of the halogen heaters, a portion not facing sheet P is coated with a heat insulating material. The size of an outer shell of the auxiliary heater 610 in a direction along the conveying path 3 is 300 mm.

A distance from the nip portion of the fixing unit 60 to position P1 (entrance of a region facing the auxiliary heater 610) is 200 mm.

The first temperature sensor 621 measures a temperature at a position (position P1) at which sheet P is located 0.2 seconds after sheet P passes through the nip portion of the fixing unit 60. For example, if a conveying rate is 400 mm/s, the first temperature sensor 621 detects the temperature of sheet P at a position 80 mm away from the nip portion.

The second temperature sensor 622 detects the temperature of sheet P at a position (position P2) where sheet P has passed through a portion facing the last heater in the auxiliary heater 610. A timing at which the second temperature sensor 622 detects the temperature is in accordance with the number of heaters to be lit in the auxiliary heater 610. For example, in a case where the number of heaters to be lit is one, the second temperature sensor 622 measures a temperature at a position at which sheet P is located 0.6 seconds after sheet P passes through the nip portion of the fixing unit 60. For example, if a conveying rate is 400 mm/s, the second temperature sensor 622 detects the temperature of sheet P at a position 240 mm away from the nip portion.

The third temperature sensor 623 detects the temperature of sheet P at a position (position P3) on a downstream side of the auxiliary heater 610. A timing at which the third temperature sensor 623 detects the temperature is in accordance with the number of heaters to be lit in the auxiliary heater 610. For example, in a case where the number of heaters to be lit is one, the third temperature sensor 623 measures a temperature at a position at which sheet P is located 1.3 seconds after sheet P passes through the nip portion of the fixing unit 60. For example, if a conveying rate is 400 mm/s, the third temperature sensor 623 detects the temperature of sheet P at a position 520 mm away from the nip portion.

Incidentally, in example (7), the second temperature sensor 622 and the third temperature sensor 623 detect the temperature of sheet P at the same position (that is, a value of t2 is equal to a value of t3).

(Correspondence Table)

Figures 9, 10:
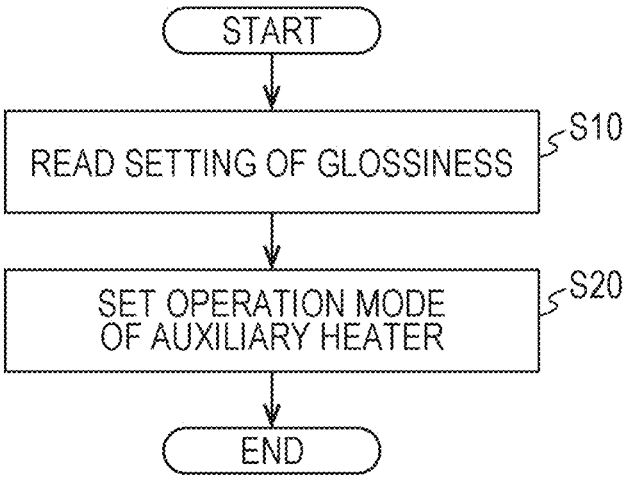
FIG. 9 is a table illustrating a correspondence relationship between a glossiness and a value of S according to formula (B) in FIG. 5.
FIG. 10 is a flowchart of a process for controlling the glossiness of an image on a sheet.

FIG. 9 is a table illustrating a correspondence relationship between a glossiness and a value of S according to formula (B) in FIG. 5. The information illustrated in FIG. 9 is stored in the storage 72, for example.

[7] Control Contents

FIG. 10 is a flowchart of a process for controlling the glossiness of an image on sheet P, executed by the CPU 101. In an example, the process of FIG. 10 is implemented by execution of a given program by the CPU 101.

In step S10, the CPU 101 reads setting regarding the glossiness of an image (toner image) to be formed on sheet P. Setting of the glossiness may be registered in advance in the MFP 500, may be input from a user via the operation unit 302, or may be included in each piece of job data. In an example, the CPU 101 starts the process of FIG. 10 every time an instruction to form an image is input to the MFP 500. In another example, the CPU 101 starts the process of FIG. 10 every time the MFP 500 forms images on a given number of sheets P.

In step S20, the CPU 101 sets an operation mode of the auxiliary heater 610 according to the setting read in step S10.

In an example, the CPU 101 conveys sheet P at the timing (t1 to t3) illustrated in FIG. 7 and controls the auxiliary heater 610 in the mode illustrated in FIG. 7. For example, it is assumed that the set glossiness is "27". In FIG. 7, the glossiness detected for example (1) is "27". From these matters, in a case where the set glossiness is "27", the CPU 101 conveys sheet P at the timing according to t1 to t3 in example (1) and controls the auxiliary heater 610 according to "lighting mode of a heater" in example (1). In order to control the conveyance of sheet P, the CPU 101 may change a conveying rate of sheet P, or may change the position of the auxiliary heater 610 (move closer to or away from the fixing unit 60).

In the MFP 500, the CPU 101 may be able to control lighting/extinction of each of the plurality of glass tube heaters of the auxiliary heater 610 and may be able to further control the surface temperature (100° C. or 80° C.) of each of the plurality of glass tube heaters.

By conveying sheet P from position P1 to position SP at the timing according to t1 to t3, the CPU 101 can control the heating time of sheet P by the auxiliary heater 610. By controlling the auxiliary heater 610 according to "lighting mode of a heater", the CPU 101 can control the heating temperature of sheet P by the auxiliary heater 610.

In a case where the glossiness illustrated in FIG. 7 is set, the CPU 101 may approximate the set glossiness to the glossiness in FIG. 7 and may determine a control mode. Alternatively, the CPU 101 may derive a value of S corresponding to the glossiness set according to formula (B) and may control heating and conveyance of sheet P after the fixing process according to six variables (T1, T2, Tm, t1, t2, and t3) for achieving the derived value of S.

As described above, the CPU 101 controls heating by the auxiliary heater 610 according to setting of the glossiness. As a result, the glossiness of an image on sheet P is controlled so as to conform to setting.

In place of setting a specific value of glossiness, the MFP 500 may set the glossiness as two kinds of modes (mode with a high glossiness and mode with a low glossiness). In this case, in step S10, the CPU 101 reads designation of a mode. Upon acceptance of designation of a low mode, in an example, the CPU 101 controls conveyance of sheet P after the fixing process such that a value of S falls within a range of $0 \leq S \leq 50$, and controls the heating temperature of sheet P. Since the value of S is within the range of $0 \leq S \leq 50$, the CPU 101 may control conveyance of sheet P (t1, t2, and t3) and may control the heating temperature of sheet P ("lighting mode of a heater") according to any one (for example, designated in advance) of examples (1) to (7) in FIG. 7. Upon acceptance of designation of a high mode, in an example, the CPU 101 controls conveyance of sheet P (t1, t2, and t3) and controls the heating temperature of sheet P according to example (8) in FIG. 7.

The CPU 101 may cool, with a cooling fan 630, the back surface of sheet P having a front surface being heated with the auxiliary heater 610. For example, in a case where the MFP 500 forms an image on the front surface of sheet P and then forms an image on the back surface thereof, the CPU 101 may heat the image formed on the back surface with the auxiliary heater 610 and may cool the image formed on the front surface with the cooling fan 630. Note that the CPU 101 may control the cooling fan 630 in order to adjust the temperature inside a casing of the MFP 500 regardless of heating of sheet P with the auxiliary heater 610.

According to an embodiment of the present disclosure, a controller of an image forming device controls a heating temperature and time with a heating unit depending on a set glossiness. As a result, the image forming device can reliably obtain a desired glossiness in an image formed on a recording medium.

Although embodiments of the present invention have been described and illustrated in detail, the disclosed embodiments are made for purposes of illustration and example only and not limitation. The scope of the present invention should be interpreted by terms of the appended claims, and intends to include all modifications within meaning and scope equivalent to the claims. In addition, the inventions described in the embodiment and modified examples thereof are intended to be implemented either singly or in combination, if possible.

What is claimed is:

1. An image forming device comprising:

a fixing unit that fixes an image formed on a recording medium;

a heating unit that heats a recording medium that has been subjected to a fixing process by the fixing unit; and a controller that sets a glossiness of an image on a recording medium, wherein the controller controls a heating amount with the heating unit depending on the set glossiness;

the controller sets a heating amount of the heating unit corresponding to the glossiness according to formula (1) representing a relationship between the glossiness and a heating temperature and time with the heating unit, $$Y=a\times\text{Log } S+b \quad (1)$$

Y represents the glossiness, a and b represent given constants,

S is represented according to the following formula (2), $$S=(T1+T2-2\times Tm)\times(t2-t1)\times 1/2+(T2-Tm)\times(t3-t2)\times 1/2 \quad (2),$$

T1 represents a temperature of a recording medium introduced into the heating unit, T2 represents a temperature of a recording medium discharged from the heating unit, Tm represents a temperature at which a storage elastic modulus of a toner constituting the image is $10^6$ Pa, t1 represents time from completion of fixing the image in the fixing unit to introduction of the recording medium into the heating unit, t2 represents time from completion of fixing the image in the fixing unit to discharge of the recording medium from the heating unit, and t3 represents time from completion of fixing the image in the fixing unit to a time point when a temperature of the toner is lowered to Tm.

2. The image forming device according to claim 1, wherein the controller can accept designation of a high gloss mode and a low gloss mode as setting regarding the glossiness, and controls the value of S within $10\leq S\leq 50$ in a case where the controller accepts designation of the low gloss mode.

3. The image forming device according to claim 1, wherein the heating unit is disposed so as to face a first surface of a recording medium, and the image forming device further comprises a cooling unit that cools a second surface of the recording medium.

4. A method for controlling an image forming device including: a fixing unit that fixes an image formed on a recording medium; and a heating unit that heats a recording medium that has been subjected to a fixing process by the fixing unit, comprising:

reading setting of a glossiness of an image on a recording medium; and controlling a heating temperature and time with the heating unit depending on the set glossiness;

wherein the heating temperature is set according to formula (1) representing a relationship between the glossiness and a heating temperature and time with the heating unit, $$Y=a\times\text{Log } S+b \quad (1)$$

Y represents the glossiness, a and b represent given constants,

S is represented according to the following formula (2)

$$S=(T1+T2-2\times Tm)\times(t2-t1)\times 1/2+(T2-Tm)\times(t3-t2)\times 1/2 \quad (2),$$

T1 represents a temperature of a recording medium introduced into the heating unit, T2 represents a temperature of a recording medium discharged from the heating unit, Tm represents a temperature at which a storage elastic modulus of a toner constituting the image is $10^6$ Pa, t1 represents time from completion of fixing the image in the fixing unit to introduction of the recording medium into the heating unit, t2 represents time from completion of fixing the image in the fixing unit to discharge of the recording medium from the heating unit, and t3 represents time from completion of fixing the image in the fixing unit to a time point when a temperature of the toner is lowered to Tm.

* * * * *